United States Patent [19]

Dye et al.

[11] 4,320,848

[45] Mar. 23, 1982

[54] DEEP DRAWN AND IRONED PRESSURE VESSEL HAVING SELECTIVELY CONTROLLED SIDE-WALL THICKNESSES

[76] Inventors: Richard G. Dye, 4 Wilderness Trail, Warren, N.J. 07060; Arthur W. Robichaud, 1 Hook Harbor Rd., Atlantic Highlands, N.J. 07716

[21] Appl. No.: 46,157

[22] Filed: Jun. 7, 1979

[51] Int. Cl.[3] ..... B65D 7/42

[52] U.S. Cl. ..... 220/72; 72/349; 220/3; 220/DIG. 22

[58] Field of Search ..... 220/72, 3, DIG. 22; 113/120 H; 72/347-349

[56] References Cited

U.S. PATENT DOCUMENTS

| | | | |
|---|---|---|---|
| 1,931,210 | 10/1933 | Steinacher | 220/DIG. 22 |
| 3,738,528 | 6/1973 | Kagami | 220/DIG. 22 |
| 4,185,749 | 1/1980 | Vartia | 220/72 |

*Primary Examiner*—Leon Gilden

*Attorney, Agent, or Firm*—Staas & Halsey

[57] ABSTRACT

An improved deep drawn and ironed metal shell for use as a pressure vessel having selectively controlled wall thicknesses to impart additional strength to predetermined portions of the improved metal shell. A stepped mandrel is utilized in conjunction with at least one ironing die to fabricate the improved metal shell.

10 Claims, 12 Drawing Figures

10
2
2
3
4
12
14
16
22
22
307
111
L
LC
LF
20
20L
20LF
20LC
12LC
12LF
L1
L2
a
b
c
d
α
β

DEEP DRAWN AND IRONED PRESSURE VESSEL HAVING SELECTIVELY CONTROLLED SIDE-WALL THICKNESSES

BACKGROUND OF THE INVENTION

1. Field of the Invention

This invention relates generally to pressure vessels of an improved design and, more particularly, to a pressure vessel formed by drawing and ironing to provide selectively controlled side-wall thicknesses, affording a structure of reduced material consumption and thus reduced weight while maintaining the required strength of the pressure vessel for use in its intended purpose.

2. Description of the Prior Art

Conventional pressure vessels, such as those used in the filter industry, are typically "drawn" vessels or containers. Drawing is a known metal fabrication technique wherein a given blank of material, particularly metal as used in pressure vessels, is reformed or reshaped to a particular, desired configuration. Drawing effectively retains or maintains the virgin, or original, material thickness throughout the walls of the vessel. Any reduction or thickening of material occurs by accident, or within the basic tolerance of established drawing techniques, which effect a maximum reduction of less than ten percent of the material thickness, more typically in the range of five to six percent. Variation in material thickness may also occur due to clearances within the dies employed in the drawing process. In some cases, die clearances are designed to create localized stretching in the material. Stretching, during a drawing operation, does not, however, impart any improved or advantageous properties to the stretched portion of the drawn metal product.

Nevertheless, drawing is an established and extensively used technique for the formation of pressure vessels, since it does permit formation of a pressure vessel of, typically, cylindrical configuration and having a closed end, without the use of seams. For example, earlier techniques would employ a flat sheet rolled into a cylinder, requiring the formation of a side seam, with the further addition of an end piece suitably seamed to the open end of the cylindrical structure. Drawing thus eliminates the side seam and the end seam of such earlier prior art pressure vessels. While affording these advantages, drawing imposes limitations as discussed above, and moreover fails to provide the capability of precisely sizing the vessel, not only as to its principal dimensions and particular diameter, but also, and to some extent more critically, as to the cross-sectional thickness of the walls of the metal vessel; in drawing operations, the latter is solely dependent upon the original or virgin material thickness. In view of the inability of drawing processes to size or control the material cross-sectional thickness, it is necessary, in the fabrication of drawn pressure vessels, to select a virgin material having a minimum thickness in light of its thickness tolerance, which is of sufficient strength to meet the maximum requirements of a pressure vessel, and to employ that same thickness throughout the entire vessel structure.

There is known in the art a fabrication technique termed "ironing", whereby metal is physically thinned by surface extension. U.S. Pat. No. 3,733,881 issued May 22, 1973 to Donald C. Grigorenko discloses a method and apparatus for making deep drawn and ironed metal shells wherein a metal disc is subjected to both drawing and ironing operations. In the particular process disclosed in that patent, a flat metal blank of virgin material is subjected to a reverse draw operation whereby the blank is shaped into a cup, or shell, of a first diameter and then is redrawn in an opposite direction to form a narrower diameter cup, or shell, of elongated axial length. The elongated shell is then subjected to successive ironing stages to reduce the side-wall thickness and thus elongate the axial dimension of the shell. The ironing technique is known to improve the physical characteristics of the ironed material in the side-walls. The conventional drawing and ironing process, however, has been used heretofore primarily for realizing material reduction, i.e., reducing the amount of material required to form a vessel of a given size, along with the elimination of the side and end seams as heretofore achieved by drawing operations alone.

Prior art drawing and ironing techniques, however, have not been suitable for the production of pressure vessels, such as oil filters for automotive applications, since such vessels require structural characteristics not heretofore capable of being achieved in shells fabricated by known drawing and ironing techniques.

SUMMARY OF THE INVENTION

The present invention comprises an improved pressure vessel having selectively controlled wall thicknesses, so as to provide the appropriate material thickness in those portions of the vessel, as required for necessary "pressure" performance, yet having ironed side-walls which are of reduced thickness throughout a substantial portion of the axial extent of the vessel. Particularly, the improved drawn and ironed pressure vessel of selectively controlled wall thicknesses in accordance with the invention includes an end closure of virgin metal thickness and integrally formed side-walls including a first side-wall portion adjacent the end closure of a first selected thickness, which may be as great as the virgin metal thickness, an extended side-wall portion comprising a major portion of the axial length of the vessel of reduced thickness formed by ironing, and a flange portion which is of a third thickness which may be as great as the virgin metal thickness.

The improved pressure vessel of the invention is formed from an initially flat metal strip which is selectively blanked or cut to desired size and shape. Typically, to form a cylindrical vessel, a disc of the virgin metal is cut. The disc is then drawn into a cup-shape, which preferably may be accomplished by the reverse drawing operation disclosed in the above cited U.S. Pat. No. 3,733,881. The resultant, drawn, elongated shell is then subjected to one or more stages of ironing, performed by a specially configured mandrel which advances the drawn, elongated shell through one or more stages of ironing rings. The mandrel may be employed as well in the final drawing stage of a reverse draw operation as disclosed in the Grigorenko patent, or instead, may be used solely for the ironing operation.

The mandrel has a configuration corresponding to the desired final configuration of the pressure vessel shell. Thus, the head of the mandrel corresponds in configuration to the desired configuration of the integral end closure of the vessel. The longitudinal surface of the mandrel likewise is formed to provide, in conjunction with the ironing rings, the desired selectively controlled wall thickness of the side-walls of the vessel. Thus, for the described configuration of the cylindrical side-wall pressure vessel above set forth, the mandrel includes a first portion of short axial extent of reduced diameter to afford a corresponding side-wall portion in the finished pressure vessel of a first dimension, contiguous to and integrally formed with the end closure, a second portion of relatively larger diameter along which the side-walls are ironed to the desired, reduced cross-sectional thickness, and a final portion again of relatively smaller diameter to provide the flange portion of the shell side-wall of relatively greater side-wall thickness. The resulting shell thus has the highly advantageous structural characteristic of reduced material requirements and lighter weight, while affording heavier thickness material in the side-wall portion integral with the end closure and in the side-wall portion forming the flange of the final pressure vessel. The improved strength in the portion of the side-wall adjacent the end closure conforms to the required structural characteristics of the pressure vessel in its normal mode of use, as does the greater thickness of the side-wall in the flange portion, the latter as well providing the desired material thickness and strength for seaming for attaching an end cap to the final pressure vessel.

In addition to the structural advantages and reduction in material and weight of the improved pressure vessel of the invention, additional advantages are also realized. The vessel material is precisely sized throughout the side-wall portion, affording a vessel that is made to an exact, repeatable standard. By utilizing drawing and ironing techniques, such as those disclosed in the Grigorenko patent, the drawn and ironed shell can be produced in a single stroke operation of appropriate equipment, the drawn and ironed shell being ready for trimming. The sizing achieved by the ironing process also permits the virgin material employed to be of much less critical tolerance, thus increasing the availability (i.e., source and acceptable tolerance) of the purchased raw, or virgin, material to be used. Since less material is employed, smaller initial discs are used as compared with conventional drawing operations, permitting better layouts in stamping the discs from sheets of virgin material and thus improving the yield of useable discs from a given sheet of material.

Another important advantage of the improved pressure vessels of the present invention is that their fabrication by use of ironing techniques requires significantly less energy than the production of pressure vessels by drawing operations. This can be appreciated from the fact that virgin material is formed in yield in ironing, as opposed to being stretched in tension in drawing.

These and other advantages of the improved pressure vessel of the invention will be more readily appreciated by reference to the following detailed description and drawings.

DESCRIPTION OF THE PREFERRED EMBODIMENT

Figures 1, 2, 3, 4, 5:
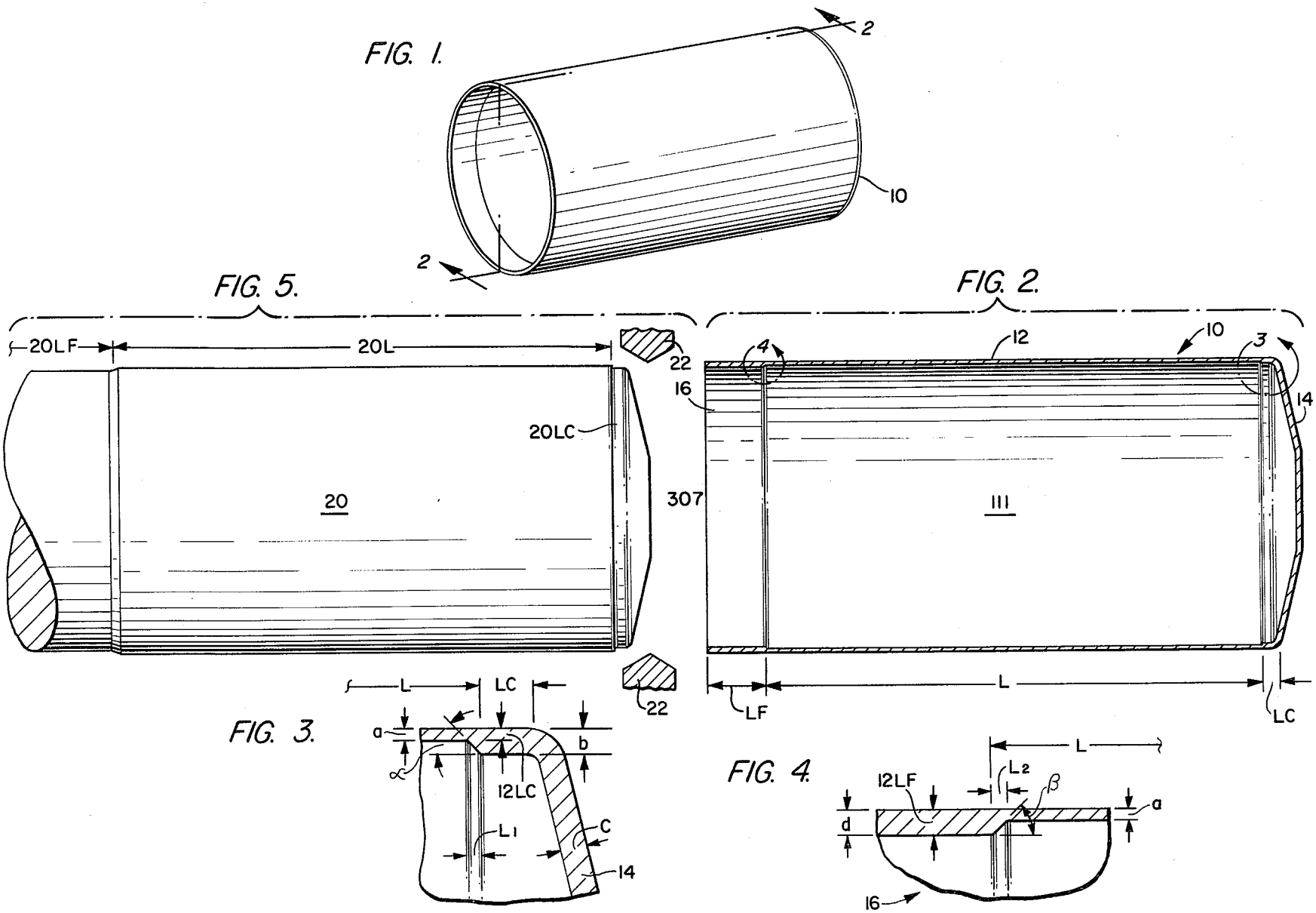
FIG. 1 is a perspective view of a drawn and ironed pressure vessel in accordance with the improved design of the invention.
FIG. 2 is a side view, in cross-section, of the shell of FIG. 1.
FIGS. 3 and 4 are enlarged fragmentary sections of the correspondingly identified portions of the structure of FIG. 2.
FIG. 5 is a side elevational view of a mandrel employed to form the shell of FIG. 2.

FIG. 1 illustrates an elongated, drawn and ironed shell 10 for a pressure vessel in accordance with the present invention. With concurrent reference to the cross-sectional view of FIG. 2 and its enlarged fragmentary sections shown in FIGS. 3 and 4, the shell 10 includes a generally cylindrical side-wall 12 having an integral end closure 14 and an open end 16. The major axial extent of the cylindrical side-wall 12, shown by the dimension L, is of a reduced thickness resultant from ironing, as later described in detail. The side-wall 12 further includes a portion 12LC of greater thickness b and of an axial dimension LC, the different thicknesses a and b of the side-wall portions being joined by a step portion of axial length L1. The interior surface of the step or inclined surface joining the thicknesses a and b is defined by the angle $\alpha$.

The side-wall 12 further includes adjacent the open end 16 a portion 12LF of axial length LF of a thickness d which likewise is joined to the side-wall portion 12 of reduced thickness a by a stepped region of axial extent L2. The interior surface of the portion L2 similarly defines an angle $\beta$. The specific values of the various dimensions identified above will vary, depending upon the specific size and material of a given shell and the operating conditions of the pressure vessel ultimately to be formed from the shell, as later discussed.

In FIG. 5 there is schematically illustrated a side elevation view of a mandrel 20 having a surface configuration corresponding to the interior of the shell 12. There is also schematically shown, partly in cross-section, an ironing ring 22 with which the mandrel 20 cooperates in performing the side-wall ironing in the fabrication of the shell 12. In general, the interior diameter of the ironing ring 22 is sufficiently larger than the exterior maximum diameter of the mandrel 20, i.e., that diameter extending along a majority of the axial length of the mandrel, so as to provide the desired, final side-wall thickness a along the axial length L of the side-wall 12 of the shell 10 as shown and discussed in relation to FIGS. 2 through 4. The diameter of mandrel 20 in the portion 20LC is of an axial length to form the corresponding, thicker side-wall portion 12LC seen in FIG. 3. The axial length of the shank of the mandrel 20, defining the portion 20LF, is non-critical, but is sufficiently great so as to provide the thicker side-wall flange portion 12LF of the side-wall 12 as seen in FIGS. 2 and 4.

Figure 6:
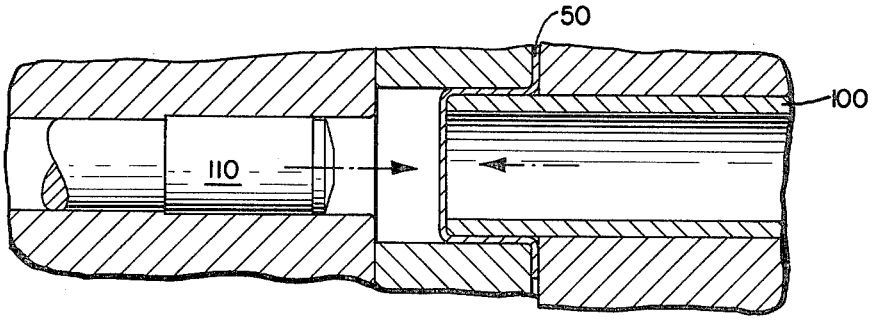
FIGS. 6 and 7 are fragmentary cross-sectional views of drawing equipment showing respective first and second stages of a two-step reverse-draw operation.
Figure 7:
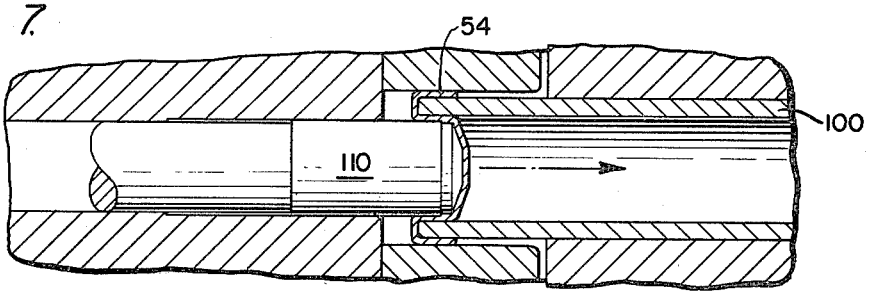
Figure 8:
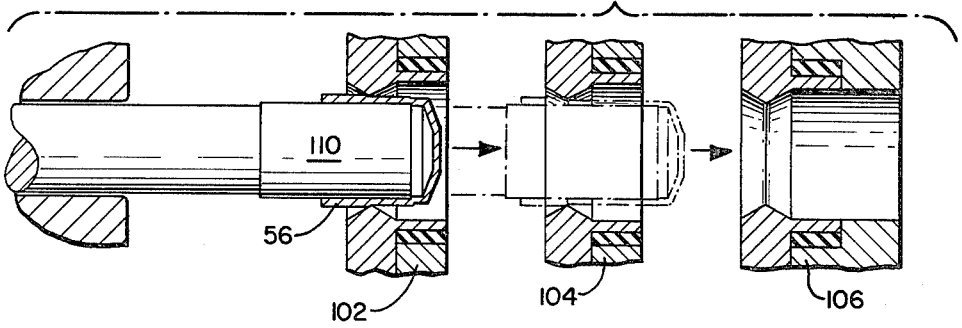
FIGS. 8 and 9 are fragmentary cross-sectional, schematic views of ironing apparatus employing three successive ironing stages.
Figure 9:
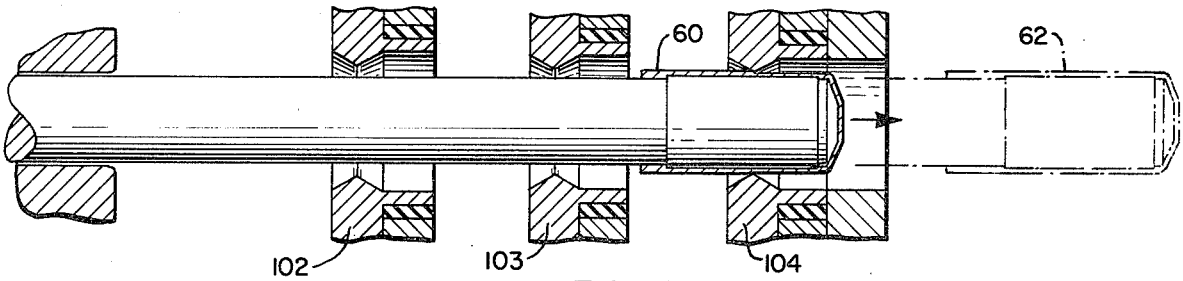
Figure 10:
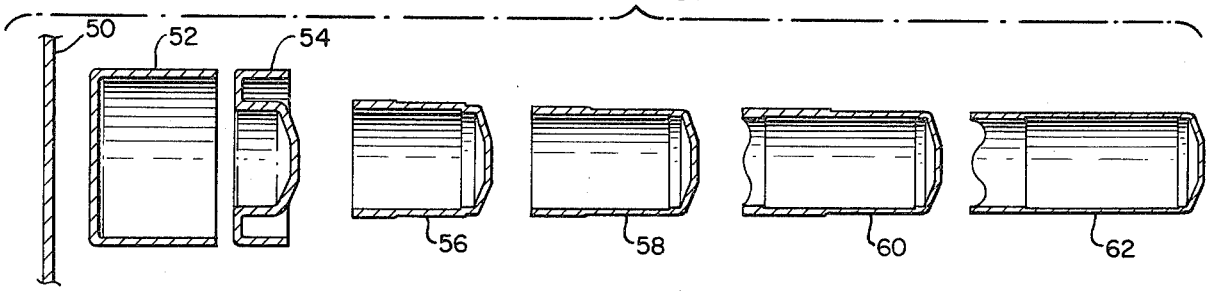
FIG. 10 is an illustrative cross-sectional view of a blank of virgin material as it has progressed through successive stages of draw, reverse-draw, and three successive ironing stages, and the resultant shell.

Prior to a discussion of the specific dimensional relationships, it is instructive, first, briefly to describe an illustrative sequence of steps by which a shell may be formed in accordance with the present invention. FIGS. 6 through 10 of the drawings are analogous to FIGS. 11 through 15, respectively, of U.S. Pat. No. 3,733,881 to Grigorenko, modified, however, to employ a specially configured mandrel for forming an elongated shell having selectively controlled side-wall thicknesses for use as a pressure vessel in accordance with the present invention. Particularly, FIGS. 6 and 7 illustrate successive steps in a reverse-draw operation and FIGS. 8 and 9 illustrate successive ironing stages in the formation of a shell as shown in FIGS. 1 and 2. FIG. 10 illustrates a virgin metal disc 50 and corresponding stages of the drawing and ironing of that disc in the forming of the final drawn and ironed shell. These successive configurations of the disc are numbered in accordance with the configurations assumed by the disc in various stages of formation as seen in the views of FIGS. 6 through 9.

In FIG. 6, the disc 50 is shown in an intermediate stage of being drawn to a first cup-shape configuration by a hollow mandrel 100 which is illustrated as moving relatively to the left. A specially configured mandrel 110, which may correspond to the mandrel 20 of FIG. 5, is illustrated in FIG. 6 as having relative motion to the right and shown more fully in FIG. 7 as having engaged and begun a reverse-draw of the disc through the interior of the hollow mandrel 100. In FIG. 10, the initially flat disc 50 is shown to be formed to a cup 52 by the first draw operation and then is shown in its partially completed reverse-draw configuration at 54, corresponding to its configuration for the stage of the operation shown in FIG. 7. The advantages of the reverse drawing operation are discussed in the above-noted Grigorenko patent. Redrawing is not essential to the fabrication of an elongated shell for a pressure vessel in accordance with the present invention, but it is a desirable technique to employ.

In FIGS. 8 and 9, there are illustrated in fragmentary cross-sectional view, three successive ironing stages 102, 104 and 106. It is believed that the successive stages of ironing of the shell as identified at 56, 58, 60 and 62 will be apparent. It should be recognized that the surface extension of the material of the side-walls of the shell achieved by ironing improves the structural characteristics of the side-wall material in those ironed portions, along with reducing the actual thickness of the side-wall in the ironed portions. The resultant, elongated shell 62 thus is of the desired, or required actual length and of precisely controlled, or sized, diameter and wall thickness. As illustrated particularly in the stages 60 and 62, the shell during fabrication does develop an irregular configuration at the open end, which is normal in such operations. The end is trimmed by conventional means to provide the final, well defined edge at the open end 16 of the shell 10 as seen in FIGS. 1 and 2.

While it would appear initially that considerable difficulty would be entailed in removing the wall ironed shell 62 from its associated mandrel 110, in fact it has been determined that the metal material of the shell has sufficient resiliency and memory to enable ordinary workpiece-stripping mechanisms to remove the shell 62 from the mandrel 110 after completion of the wall ironing operations.

Referring again to FIGS. 2 through 4, it will now be appreciated that the thickness c of the end closure 14 is that of the virgin metal of the disc from which the shell is formed. In the drawing operation prior to ironing, such as the reverse draw operation of FIG. 7, the act of drawing may itself suffice to configure the thick side-wall portion 12LC to the reduced diameter surface 20LC of the mandrel 20. In the event precise conformity is not achieved during the draw, the successive ironing steps will provide that conformity. In this regard, depending upon design requirements, thickness b of the portion 12LC may be of the virgin metal thickness c, in which event the ironing rings merely serve to flatten the original material, in its virgin metal thickness, against the mating surface 20LC of the mandrel. If desired and permitted, however, thickness b may be less than thickness c in which event the successive ironing stages will serve both to flatten and to iron the material in the portion 12LC to some dimension b less than the virgin thickness c.

The major reduction of side-wall thickness, of course, occurs in the transition from the thickness b to the thickness a, which is in every case a function of actual wall ironing. Whereas a single stage of ironing may suffice, FIGS. 8 and 9 illustrate, merely for illustrative purposes, that two, three or more stages of ironing may be employed. The number of stages will be dependent primarily upon the speed of production desired, the greater the amount of reduction required to be performed in each individual stage typically requiring a corresponding slower operating speed. Thus, by reducing the amount of reduction required to be performed in each ironing stage, and employing plural ironing stages, higher throughput rates may be achieved.

A similar observation applies as to the formation of the thicker flange portion 12LF as was noted above with regard to the thicker portion 12LC adjacent the end closure portion 14. Particularly, the thickness d may correspond to virgin metal thickness c in which case the drawing and subsequent ironing operations merely serve to flatten the metal about the reduced diameter portion 20LC of the mandrel. Again, if reduction in the thickness d from that of the virgin metal c is desired, the diameter of the mandrel portion 20LF will be selected so as to cause the ironing rings to iron the metal in the flange portion 12LF as well.

Figure 12:
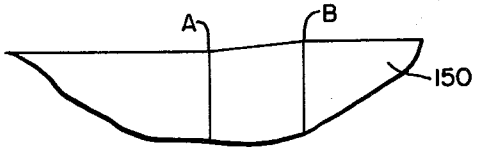
FIG. 12 is an enlarged sectional view of a stepped portion of the surface of the mandrel of FIG. 11.
Figure 11:
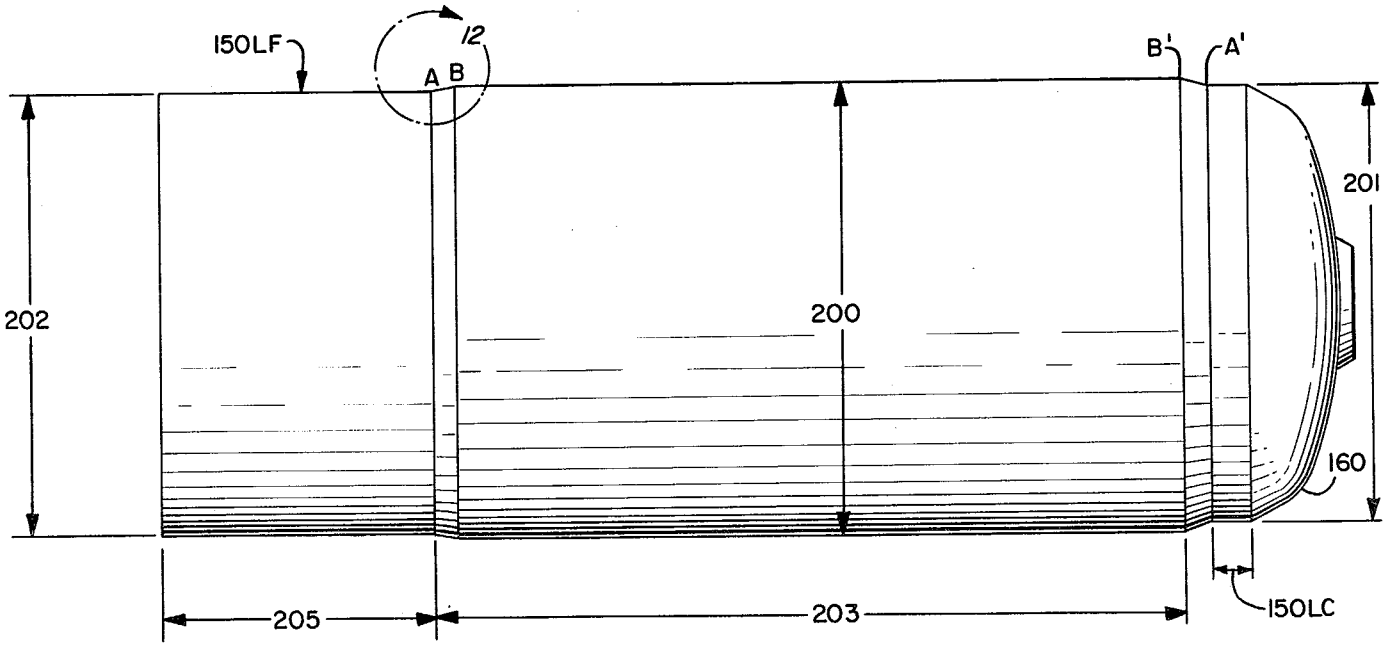
FIG. 11 is a side elevational view of a mandrel suitable for use in the fabrication of pressure vessels in accordance with this invention.

FIG. 11 is a side elevational view of a mandrel 150, FIG. 12 comprising an enlarged fragmentary section of the mandrel 150 for illustrating a step between larger and smaller diameters of the mandrel surface. The nose 160 of the mandrel preferably is detachable, such that different nose pieces 160 may be secured to the main body of the mandrel 150 to provide different configurations to the end closures. In the illustration of FIG. 10, a convex end surface having a central raised portion would result. The nose, or end detail, 160 as well defines the axial extent of the reduced diameter portion 150LC corresponding to the thicker side-wall portion 12LC in FIG. 3 of the finished shell.

The enlarged fragmentary section of FIG. 12, although oriented and indicated as the trailing edge of the mandrel 150 leading to the reduced diameter portion 150LF, as well is illustrative of the step portion of the mandrel adjacent the end detail. With reference to FIG. 12, the juncture A would normally be sharply defined, whereas the juncture B would be defined by a radius blending the angle of that juncture to the immediately adjacent diameters of the mandrel surface. Those corresponding junctures are identified at A and B, and at A′ and B′ for the respectively opposite ends of the mandrel as seen in FIG. 11.

As an example of the dimensions of a typical mandrel for forming a shell in accordance with the present invention, the mandrel of FIGS. 10 and 11 may have a main diameter 200 on the order of four inches, and a major length 203 on the order of seven inches. The shank of the mandrel, about which the flange at the open end of the shell is formed, may have a length 205 on the order of three inches. The diameter 201 of the nose, or detail, 160 may be on the order of 11 thousandths of an inch (0.011") smaller than the major diameter 200. The shank diameter 202 as well may be on the order of 11 thousandths of an inch (0.011") smaller than the major diameter 200. As before noted, the thicker side-wall portion adjacent to and integral with the end closure, or dome, of the shell may be of virgin metal thickness or ironed to a lesser thickness, and as well the flange portion formed about shank 150LF of the mandrel 150 similarly may be of virgin metal thickness or ironed to a lesser thickness.

As one example, assuming a virgin metal thickness of 25 thousandths of an inch (0.025") and for the dimensions of the mandrel 200 above set forth, the dome of the finished shell formed about nose 160 will have a final thickness of the original virgin metal, or 25 thousandths of an inch (0.025"), the integral side-wall portions adjacent the end closure will be ironed to a thickness of 12.5 thousandths of an inch (0.0125"), the ironed side-walls formed along the major length 203 of the mandrel 150 will have a thickness of 12.5 thousandths of an inch (0.0125"), and the flange ironed about the shank of the mandrel will have a side-wall thickness of 18 thousandths of an inch (0.018"). These dimensions are merely illustrative, and not limiting. For example, a larger virgin material thickness may be employed if even greater strength is required in the dome. Each of the diameters 201 and 202 may be individually selected to provide the desired thickness in the side-wall portion adjacent to and integral with the dome, and in the flange side-wall portion, respectively.

The stepped portions of the mandrel surface extending between the major diameter 200 and the reduced diameters 201 and 202 define an acute angle relatively to the mandrel axis, preferably less than 45°, but may vary depending upon the relative difference between the respective diameters. For the example above given, the axial extent of the inclined or stepped portion is 0.125 inches and the radial difference is 0.0055". As shown, the step or incline has a flat surface in cross-section, and generally would be defined as a truncated conical surface, although other surfaces may be employed. Again, although not critical, it is preferred that the juncture B' not be sharp but instead that the portion of the inclined surface immediately adjacent the major mandrel diameter 200 be blended, such as at a radius of 0.010 inches. The juncture A' on the other hand may be a sharp juncture. The angle blend at the juncture B particularly serves to assist in the withdrawal of the final, drawn and ironed shell from the mandrel.

Drawn and ironed shells formed on the mandrel of the general dimensions and dimensional relationships described above in connection with FIG. 10 have been successfully produced and tested, and have been shown to satisfy all operational requirements of conventional filter pressure vessels. The actual dimensions of the mandrel will depend, of course, upon the dimensions of the filter vessel to be produced. The extent of the side-wall reduction for the major extent of the side-walls of the filter vessels will depend upon the pressure conditions to which the vessels ultimately are subjected in normal use, which conditions as well tend to establish the minimum required thickness of virgin metal. Whereas for the above example, a reduction in side-wall thickness of a ratio of 2:1 has been described, reductions of any desired amount may be achieved. Realistically, it is believed that maximum practical reduction ratios are in the range of about a ratio of 4:1. In view of the precise sizing afforded by ironing, the upper limit, on the reduction ratio in the side-walls of a shell to be employed in a practical filter vessel, will be determined by the required strength of the vessel, given its normal use requirements. Relevant considerations in addition to the pressure conditions to which the vessel is subjected include structural integrity of the vessel and its resistance to external conditions such as impact, puncture and the like, as well as its ability to withstand handling, such as in installation and removal. It is believed, nevertheless, that substantially all pressure vessels, such as those used for fluid filtration, for automotive and other purposes, may be fabricated as taught herein to incorporate selectively controlled side-wall thicknesses, in accordance with the present invention.

Whereas the foregoing drawings and description illustrate only the fabrication of a shell for a pressure vessel, conventional techniques are intended to be employed to complete the construction of an actual pressure vessel. Trimming of the flange of the shell to its final proper length is as well a conventional technique. The flange thereafter may be joined to a conventional end cap by rolling, in forming an oil filter can as disclosed in U.S. Pat. No. 4,127,484 to Walulik et al. Suffice it to say that any conventional finishing steps for final assembly of a pressure vessel may be utilized.

Numerous modifications and adaptations of the improved pressure vessel of the invention will be apparent to those skilled in the art. Thus, for example, whereas in the foregoing, a pressure vessel having a uniform, reduced side-wall thickness through a major extent of its length and of fixed diameter throughout has been shown, it is contemplated that variations in the surface configuration of the side-wall may be provided, such as ribbing or fluting. As well, further, selectively controlled thickness portions may be provided; for example, a thicker band may be formed circumferentially at a central portion of the major dimension L of the shell in FIG. 2 for reinforcement, to permit welding a bracket to the exterior of the shell 10 at such a reinforcing band location.

These and other adaptations and modifications of the invention readily will be apparent to those skilled in the art, and thus it is intended by the appended claims to cover all such modifications and adaptations which fall within the true spirit and scope of the invention.

We claim:

1. A pressure vessel including a drawn and ironed elongated metal shell with a plurality of stepped internal diameters having a seamless drawn closed end having a first wall thickness, a first axial portion immediately adjacent said closed end having a second wall thickness effected by one of said stepped internal diameters, a second axial portion immediately adjacent said first axial portion and having a third wall thickness effected by another of said stepped internal diameters, and a fourth axial portion immediately adjacent said third axial portion and having a fourth wall thickness effected by a further one of said stepped internal diameters.

2. A pressure vessel as in claim 1, wherein said first wall thickness is equal to said second wall thickness.

3. A pressure vessel as in claim 1, wherein said first wall thickness is greater than said second wall thickness.

4. A pressure vessel as in claim 1, wherein said third wall thickness is less than said first or second wall thicknesses.

5. A pressure vessel as in claim 1, wherein said fourth wall thickness is greater than said third wall thickness.

6. A pressure vessel as in claim 1, wherein said fourth wall thickness is equal to said first wall thickness.

7. A pressure vessel as in claim 1, wherein said third wall thickness is less than said first or second wall thicknesses, and said fourth wall thickness is greater than said third wall thickness.

8. A pressure vessel as in claim 7, wherein said fourth wall thickness is equal to said first wall thickness.

9. A pressure vessel as in claim 8, wherein said stepped internal diameters are connected internally of the elongated metal shell by an angled step between each of said internal diameters.

10. A pressure vessel as in claim 9, wherein at least one of said angled steps between said internal diameters is blended at the junction thereof with the adjacent internal diameter and the other portion thereof is a sharp junction with the adjacent internal diameter.

* * * * *

UNITED STATES PATENT AND TRADEMARK OFFICE

CERTIFICATE OF CORRECTION

PATENT NO. : 4,320,848

DATED : March 23, 1982

INVENTOR(S) : Richard G. Dye et al

It is certified that error appears in the above—identified patent and that said Letters Patent is hereby corrected as shown below:

Claim 1, line 10, change "fourth" to --third--;
line 11, change "third" to --second--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*